US005168669A

United States Patent [19]

Knapp

[11] Patent Number: 5,168,669

[45] Date of Patent: Dec. 8, 1992

[54] ADJUSTABLE LOWER EDGE SEAL ASSEMBLY FOR EXTERIOR DOOR AND STORM DOOR

[75] Inventor: Steven E. Knapp, Brossard, Canada

[73] Assignee: RCR International Inc., Longueuil, Canada

[21] Appl. No.: 766,338

[22] Filed: Sep. 27, 1991

[51] Int. Cl.[5] ..... E06B 7/16

[52] U.S. Cl. ..... 79/482; 49/470

[58] Field of Search ..... 49/467, 468, 470, 482, 49/484, 486, 488, 493, 494, 505

[56] References Cited

U.S. PATENT DOCUMENTS

| | | | |
|---|---|---|---|
| 3,448,543 | 6/1969 | Multer | 49/470 |
| 3,545,135 | 12/1970 | Lieber | 49/505 |
| 3,604,152 | 9/1971 | Protzman | 49/470 |
| 3,854,246 | 12/1974 | McAllister | 49/470 |
| 4,185,417 | 1/1980 | McKann | 49/470 |
| 4,300,314 | 11/1981 | Dittrich | 49/470 |
| 4,513,536 | 4/1985 | Giguere | 49/470 |
| 4,782,630 | 11/1988 | Kleyn | 49/505 |

*Primary Examiner*—Renee S. Luebke
*Assistant Examiner*—Jerry Redman

[57] ABSTRACT

An adjustable lower edge seal assembly for an exterior door whereby to seal the bottom edge of the door with the floor below the door frame or a door threshold. The assembly comprises an elongated sealing strip member having a seal carrying base and a transverse edge attachment flange which is secured to an outer face of a door adjacent the lower edge thereof. A flexible seal projects outwardly of the base. The flange is also provided with holes to receive fasteners to secure it to the lower edge wall of the door. The base is also provided with an adjustable connector to receive a connector flange of a stabilizing connector strip member therein. The stabilizing connector strip member has an abutment wall to abut an opposed face of the door adjacent an opposed lower edge of the door.

9 Claims, 1 Drawing Sheet

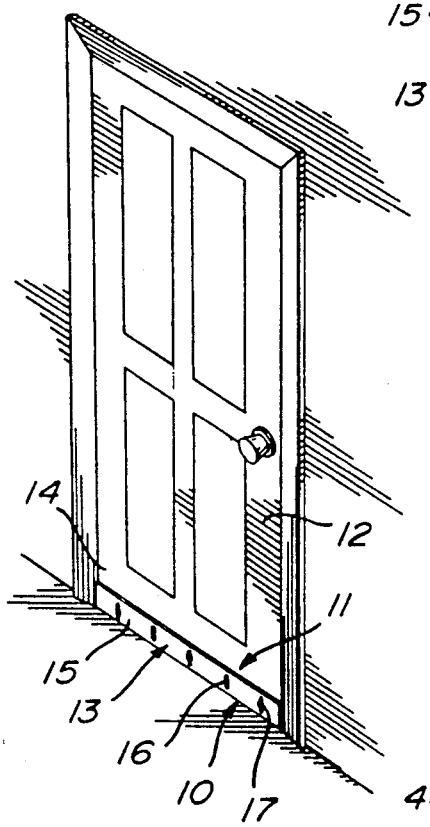
FIG. 1
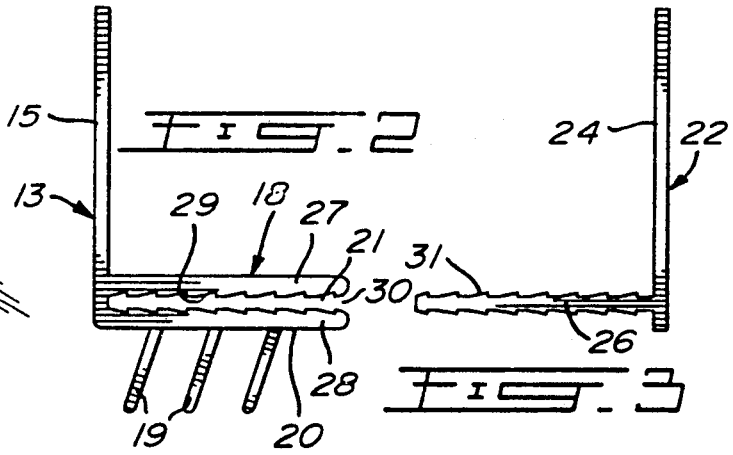
FIG. 2
FIG. 3
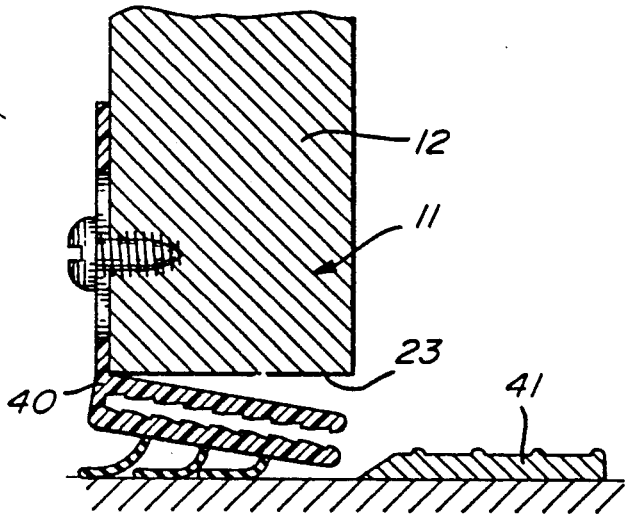
FIG. 6
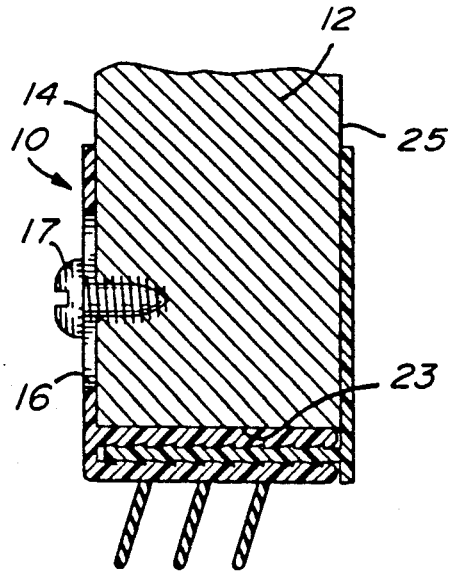
FIG. 4
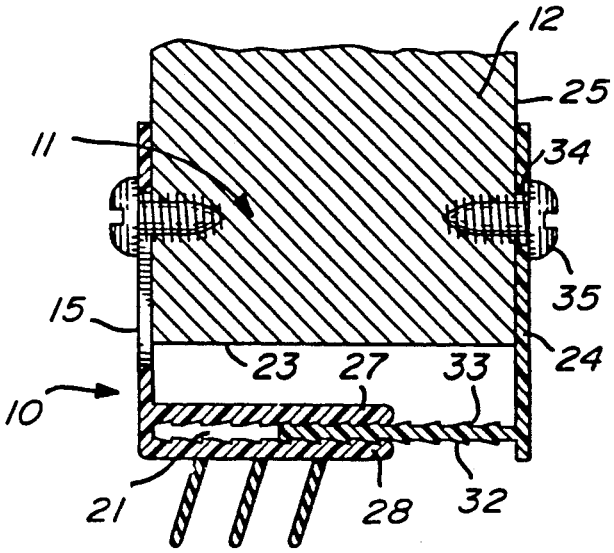
FIG. 5

ADJUSTABLE LOWER EDGE SEAL ASSEMBLY FOR EXTERIOR DOOR AND STORM DOOR

BACKGROUND OF INVENTION

1. Field of the Invention

The present invention relates to an adjustable lower edge seal assembly for securing over the lower edge surface of an exterior door and can adapt to doors of different thicknesses whereby to secure a seal between the lower edge surface of the door and the floor or a door pedestal.

2. Description of Prior Art

Various sealing components are known and which are attachable, in most cases, to a lower edge surface of the front or rear face of an exterior storm door whereby to secure a seal between the lower edge surface of the storm door and the floor or a door frame pedestal. It is also known to provide an angle strip member whereby a seal may be located along the lower edge surface of the door. A disadvantage of these sealing components is that they often break as its securement is not sufficiently rigid because the sealing strip member is secured only to the door bottom edge surface or to one angle edge thereof. Another disadvantage angled sealing members is that they are sometimes difficult to install and wear out or break during usage because they are continuously scraping the floor or a threshold when the door is opened and closed.

SUMMARY OF INVENTION

It is a feature of the present invention to overcome the above-mentioned and other disadvantages of the prior art by the provision of an adjustable lower edge seal assembly and wherein the seal is adjustably positioned below the door lower edge surface and wherein the seal assembly can be secured to doors of different thicknesses.

Another feature of the present invention is to provide an adjustable lower edge seal assembly which comprises an elongated, sealing strip member which is connected to a bottom lower edge of one face of a door, and a stabilizing connector strip member which is securable to the sealing strip member and which abuts the opposed face of the door.

Another feature of the present invention is to provide an adjustable lower edge seal assembly which is easy to install and replace and which provides improved sealing characteristics.

According to the above features, from a broad aspect, the present invention provides an adjustable lower edge seal assembly for an exterior door. The seal assembly comprises an elongated sealing strip member having a seal carrying base and a transverse edge attachment flange. Flexible sealing means projects outwardly of the base. The flange has means for securing same to a face of a door adjacent a lower edge thereof. Adjustable connecting means is provided in the base. A stabilizing connector strip member is also provided and has a connector for adjustable engagement with the adjustable connecting means. The stabilizing connector strip member has abutment means to abut an opposed face of the door adjacent an opposed lower edge thereof.

BRIEF DESCRIPTION OF DRAWINGS

A preferred embodiment of the present invention will now be described with reference to the accompanying drawings, in which:

FIG. 1 is a perspective view of an exterior door showing the adjustable lower edge seal assembly of the present invention as secured to the bottom edge surface of a door;

FIG. 2 is a section view of the elongated sealing strip member;

FIG. 3 is a section view of the stabilizing connector strip member;

FIG. 4 is a section view of a door bottom edge portion showing the adjustable lower edge seal assembly of the present invention as secured thereto;

FIG. 5 is a section view similar to FIG. 4 but showing the adjustable lower edge seal assembly as secured to the bottom edge portion of a door having a greater thickness than the door of FIG. 4 and with the seal carrying base spaced from the door lower edge surface; and FIG. 6 is a section view illustrating the need for the stabilizing connector strip member with relation to the sealing strip member.

DESCRIPTION OF PREFERRED EMBODIMENTS

Referring now to the drawings, there is shown generally at 10, the adjustable lower edge seal assembly of the present invention for securement to the bottom edge portion 11 of an exterior door 12 often referred to as a storm door. As shown in FIG. 1, the assembly comprises an elongated sealing strip member 13 which is secured to the outer surface 14 of the exterior door 12 by means of an edge attachment flange 15. The flange is provided with a plurality of spaced-apart elongated transverse slots 16 whereby to receive screw fasteners 17 therein. The slots permits for the elongated sealing strip member 13 to be adjustably secured in the vertical plane, as better shown in FIG. 5 and this is known in the art.

Referring now additionally to FIGS. 2 to 5, it can be seen that the elongated sealing strip member 13 has a seal carrying base 18 formed integral with the transverse edge attachment flange 15. A flexible seal member in the form of angularly and outwardly extending sealing fins 19 depends from a lower surface 20 of the seal carrying base 18. An adjustable connecting means or connector 21 is formed within the seal carrying base 18.

A stabilizing connector strip member 22 is also provided to maintain the seal carrying base 18 rigid in a substantially parallel plane with respect to the lower edge surface 23 of the door 12, as shown in FIGS. 4 and 5. This stabilizing connector strip is also an elongated angle member and has an abutment wall 24 for abutting the inner surface 25 of the door 12 adjacent the bottom edge thereof, and a connector flange or wall 26 for engagement within the adjustable connection 21 of the seal carrying base.

As shown more clearly in FIG. 2, the seal carrying base is comprised of two spaced-apart parallel elongated flat walls 27 and 28 defining therebetween a connecting channel 30 which constitutes the adjustable connector 21. Both the strip members 13 and 22 are extruded from plastics material and, accordingly, the walls 27 and 28 are flexible walls. A plurality of elongated engageable teeth formations 29 are disposed side-by-side along an inner face of the flat walls 27 and 28 and aligned with one another and face inwardly of the channel 30. The connector wall 26 of the stabilizing connecting strip member 22 is also provided with a plurality of elongated parallel engaging teeth 31 disposed on opposed surfaces thereof. The engaging teeth 31 are dimensioned for engagement with the engageable teeth formations 29 in the channel 30 when the connector wall 26 is inserted therein. As shown in FIG. 5, when the connecting wall 26 is inserted within the channel 30, the walls 28 and 27 will flex permitting entry of the connecting wall 26 therein and engagement of the engaging teeth 31 with the teeth formation 29. The distance of penetration of the connecting wall 26 within the channel 30 will depend on the thickness of the door 12 as the abutment flange 24 will abut the inner door surface 25 and restrict the penetration of the connecting wall 26 within the channel of the adjustable connector 21.

As shown in the drawings, the teeth formations 29 and the teeth 31 formed in the connecting wall have similar cross-sectional configuration and each have an upwardly and rearwardly sloping front wall 32 and a transverse rear retention wall 33 to define teeth of saw-tooth cross-section. The teeth in the channel 30 and those of the connecting wall 26 face in opposed direction whereby they can engage and lock with one another.

The abutment flange 24 may also be provided with holes 34 therein to receive screw fasteners 35 to provide added rigidity to the assembly, particularly when the seal carrying base 18 is maintained a larger distance spaced below the bottom edge surface 23 of a door, as shown in FIG. 5.

The sealing fins 19 are thin web plastic fins formed integral with the flat bottom wall 28 of the seal carrying base 18 and are disposed at an angle extending outwardly in the direction of the edge attachment flange 15. One or a plurality of sealing fins 19 may be molded in the base 18 and they may have a different cross-sectional configuration from those shown in these drawings.

The advantage and the need for the stabilizing connector strip is better illustrated in FIG. 6. As shown in FIG. 6, if the stabilizing connector strip member 22 was not present, the seal carrying base 18 of the sealing strip member 13 could eventually weaken in the joint region 40 between the attachment flange 15 and the seal carrying base 18 due to many door openings and closings. This could eventually cause the seal carrying base 18 to strike the door pedestal 41 and cause damage to the sealing strip member rendering the sealing fins 19 ineffective. Such disadvantage would be more apt to occur, particularly if the seal carrying base 18 was spaced from the door bottom edge surface 23 as shown in FIG. 5. However, with the stabilizing connector strip member, the seal carrying base 18 is connected from both sides of the door and supported in a rigid plane parallel to the floor surface or transverse to the attachment flange 15 and the abutment flange 24.

From the above description and drawings, it can be seen that the adjustable lower edge seal assembly of the present invention is extremely easy to secure to existing doors without removal of the door. Most important, it can also be secured to doors of different thicknesses.

It is within the ambit of the present invention to cover any further obvious modifications provided such modifications fall within the scope of the appended claims.

I claim:

1. An adjustable lower edge seal assembly for an exterior door, said seal assembly comprising an elongated sealing strip member having a seal carrying base and a transverse edge attachment flange, flexible sealing means projecting outwardly of said base, said flange having means for securing same to a face of a door adjacent a lower edge thereof, adjustable connecting means in said base, and a stabilizing connector strip member having a connector for adjustable engagement with said adjustable connecting means, said stabilizing connector strip member having abutment means to abut an opposed face of said door adjacent an opposed lower edge thereof, said seal carrying base having two spaced-apart parallel elongated flexible flat walls of equal length defining therebetween a connecting channel, said adjustable connecting means being comprised of a plurality of elongated engageable teeth formations disposed side-by-side along an inner face of said flat walls and aligned with one another and facing inwardly of said channel, said connector of said stabilizing connector strip being an elongated connecting flat wall having a plurality of elongated parallel engaging teeth on opposed surfaces, said engaging teeth being dimensioned for engagement with said engageable teeth formations on both surfaces of said connecting channel when said connector is disposed in said channel with said abutment means arresting the distance of penetration of said connector in said channel by abutment engagement of said opposed face of said door, said distance of penetration being dependent on the thickness of said door.

2. An adjustable lower edge seal assembly as claimed in claim 1 wherein said abutment means is a flange wall extending transversely to said elongated connecting flat wall.

3. An adjustable lower edge seal assembly as claimed in claim 2 wherein said sealing strip and said stabilizing connector strip are extruded plastics material strips.

4. An adjustable lower edge seal assembly as claimed in claim 2 wherein said flange wall of said stabilizing connector strip is provided with a plurality of holes to receive fasteners for securing same to said opposed face of said door adjacent an opposed bottom edge of said door.

5. An adjustable lower edge seal assembly as claimed in claim 1 wherein said means for securing said attachment flange is an adjustable means comprised by two or more elongated slots disposed spaced-apart and extending transversely to the longitudinal axis of said attachment edge flange to permit said seal carrying base to be disposed at a desired position spaced below said door bottom edge for sealing engagement with a door frame surface below said door when in a closed position, said seal carrying base being stabilized in a plane below said door bottom edge by said connector of said stabilizing connector strip.

6. An adjustable lower edge seal assembly as claimed in claim 1 wherein said flexible sealing means is comprised of two or more sealing fins depending from an outer one of said flat walls defining said connecting channel.

7. An adjustable lower edge seal assembly as claimed in claim 6 wherein said sealing fins are disposed at an angle extending outwardly in the direction of said edge attachment flange.

8. An adjustable lower edge seal assembly as claimed in claim 6 wherein said edge attachment flange of said elongated sealing strip is secured to a lower edge of said outer face of said door, said abutment means of said stabilizing connector strip abutting an inner face of said door at a lower edge thereof.

9. An adjustable lower edge seal assembly as claimed in claim 1 wherein said engageable teeth formations in said channel each have an upwardly and rearwardly sloping front wall and a transverse rear retention wall to define teeth of saw-tooth cross-section, each said engaging teeth on opposed surfaces of said connecting flat wall of said stabilizing connector strip having a rearwardly sloping front wall extending from a free end of said connecting flat wall, and a transverse rear engaging wall for facial engagement with said rear retention wall of said engageable teeth formations in said channel.

* * * * *